United States Patent [19]

Errichiello

[11] 4,352,583

[45] * Oct. 5, 1982

[54] BINDERS FOR TELEPHONE DIRECTORIES AND LIKE BOOKS AND TAMPER PROOF LANYARD SUSPENSION THEREOF

[76] Inventor: Dominic R. Errichiello, 389 Meadowlark Rd., Bloomingdale, Ill. 60108

[ * ] Notice: The portion of the term of this patent subsequent to Mar. 10, 1998, has been disclaimed.

[21] Appl. No.: 122,312

[22] Filed: Feb. 19, 1980

Related U.S. Application Data

[63] Continuation-in-part of Ser. No. 63,832, Aug. 6, 1979, Pat. No. 4,255,065.

[51] Int. Cl.[3] ..... B42D 3/10

[52] U.S. Cl. ..... 402/75; 248/447; 281/36; 281/45; 402/80 R

[58] Field of Search ..... 281/15 A, 29 A; 402/2, 402/80 R, 80 P; 248/359, 222.4, 445, 447, 317; 24/128, 201 A

[56] References Cited

U.S. PATENT DOCUMENTS

| | | | |
|---|---|---|---|
| 1,215,898 | 2/1917 | Bartlett | 281/15 A |
| 2,552,704 | 5/1951 | Armstrong | 402/2 X |
| 3,425,421 | 2/1969 | Feder | 281/29 X |
| 3,617,074 | 11/1971 | Rigolini | 402/80 P X |
| 4,132,501 | 1/1979 | Simpson | 281/15 A |

*Primary Examiner*—Paul A. Bell
*Assistant Examiner*—John S. Brown
*Attorney, Agent, or Firm*—Keil & Witherspoon

[57] ABSTRACT

This invention in general relates to improvements in telephone directory binders for telephone books used in public telephone facilities and like books, where the books and binders are subjected to hard use and often are the target of vandalism and theft; and to improvements in lanyards for hanging the binders, the securing thereof in the binders, and improved wall mounting members to secure the opposite ends of the lanyards on a wall or other surface, e.g., adjacent the public telephone.

18 Claims, 19 Drawing Figures

BINDERS FOR TELEPHONE DIRECTORIES AND LIKE BOOKS AND TAMPER PROOF LANYARD SUSPENSION THEREOF

RELATED APPLICATION

This application is a continuation-in-part of my copending application Ser. No. 063,832, filed Aug. 6, 1979, now U.S. Pat. No. 4,255,065 issued Mar. 10, 1981.

BACKGROUND OF THE INVENTION

It has been a common practice of many years to secure the soft cover telephone directories placed at public telephone facilities in hard cover binders in order to protect the directories against wear, weather, etc. The binders in turn were chained or otherwise secured to the facilities in order to prevent accidental removal or theft. None of the known security devices has proved to be tamper-proof. Telephone companies report annual losses of telephone directories from public telephone facilities in the thousands—adding a substantial cost factor to telephone operations in the replacement of directories and their binders.

BRIEF STATEMENT OF THE INVENTION

This invention provides improvements in hard cover binders for telephone directories or like books, hereinafter referred to as directory or directories, by use of essentially tamper-proof hardware to fasten the directories in the binders. It further provides one piece molded binders which are relatively inexpensive to manufacture and yet are resistant to damage by vandalism. The moldings include a segment on the spine which houses the tongue of a winged, thin member inserted between pages of the directory and sliced through the spine of the directory to hold it in the binder when the tongue is locked against movement.

In my aforesaid parent application, the spine is provided with a thick segment which has a passage coinciding with the hole in the tongue for inserting a cable-or-chain mounting ring or other security-type attachment by which the bound directory is secured to the public telephone facility by means of a cable, chain, etc.

The additional improvements disclosed herein involve new ways of securing one end of a lanyard (e.g., a cable, chain, armored rope, etc.) to the spine of the binder and the other end of the lanyard to an improved wall mounting member; to integrally molded structures within a rectangular depression formed by opposite side walls and opposite end walls on the inner face or side of the spine; the securing of one directory or two or more side-by-side telephone directories by a respective thin metal member with the back(s) of the directory or side-by-side directories held within the rectangular depression so that they cannot be moved sidewise or lengthwise out of the binder; the provision in the aforesaid integrally molded structures of walls defining one or more passages terminating at one end in a recess and at the other end in a transverse aperture through the spine to its outer face or side, one end of the lanyard having an enlarged head lying in the recess and the contiguous part of the laynard lying in the passage and exiting through the aperture; the back(s) of the telephone directory or directories lying over the recess and passage(s) to hold the head in the recess and the lanyard in the passage; and the provision of additional walls in the aforesaid integrally molded structures to provide a tongue-receiving slot or slots for mounting a single directory or multiple directories in one binder, two of the additional walls having aligned holes positioned to align with the respective hole in the tongue(s) inserted in the recess(es) so that a pin can be tightly but removably mounted in the aligned holes to hold the tongue in the spine.

More particularly, the invention provides binders for telephone directories used in public telephone facilities and the like, which binders have a front cover panel, a rear cover panel, and a spine along whose opposite longitudinal edges the front and rear cover panels respectively are hingedly connected, said front cover panel, said rear cover panel and said spine preferably constituting an integral molding of a thermoplastic polymer with said spine and said cover panels being hingedly connected by living hinges. A single telephone directory or two or more side-by-side directories is/are protectively secured on said spine between said cover panels by a respective thin metal member with oppositely extending wings adapted to lie between and against the bound edges of the pages of each directory. The thin metal member has a thin edged tongue adapted to penetrate the bound edges of said pages and project through a slot or slots in the spine. There is a hole through the spine-projecting part of said tongue. Means such as a ring or pin coacts with said hole and said spine for locking said tongue and said wings in directory-securing position to prevent removal of said telephone directory from said binder.

Most preferably, said last-mentioned means comprises a pair of holes in integrally molded wall structures within a depression in the inner face or side of the spine and on opposite sides of said tongue when it is inserted in said slot in said spine. The pair of holes and the hole in the slot-inserted tongue are substantially aligned. A pin is tightly but removably seated in and extends through the three holes to secure said thin metal member in its directory-holding position. The pin may take any one of many forms. For example, the pin may have a threaded end threadably fitted in one of said pair of holes or in a bushing press-fitted therein. In another form, the pin may be a springable ferrule or tube springably compressibly seated in said pair of holes.

As stated above, the inner side or face of the spine of said binder preferably has a rectangular depression formed by a frame composed of opposite side walls and opposite end walls for securely holding the back of said directory or the backs of two or more directories. This frame, when the directory or side-by-side directories is/are held tightly in the depression by the thin metal members, prevents removal of the directory or directories by slipping it/them sidewise or lengthwise out of the binder.

One mode for attaching the lanyard to the binder uses wall structures integrally molded in the inner side or face of the spine. The inner side of said spine has a longitudinal groove intercepting a recess in said inner side. Alternatively, the spine may have two longitudinal grooves on opposite sides of the recess. A passage extends between said groove(s) and the outer side of said spine. With two grooves, the passage for one groove is near the upper edge of the spine, and the passage for the other groove is near the center of the spine the lanyard extending through one passage and its groove to provide means for hanging said binder and directory adjacent a telephone. A head (an enlarged member) on said lanyard is seated in said recess and prevents said lanyard from being pulled out of the groove and its passage. Preferably, the back of the binder-mounted telephone directory lays across said groove(s) and recess to preclude access to the portion of said lanyard in said groove(s) and recess. When two sets of grooves and passages are provided, the lanyard is mountable in either set. One hangs the binder with its spine substantially or nearly vertical, the other with the spine substantially horizontal.

As an alternative mode for attaching the lanyard to the binder, the spine has a transverse passage extending from the inner side to the outer side of said spine. At least a portion of the passage is tapered. A tapered plug is matingly seated in said tapered portion. One end of the lanyard is fixedly mounted in said plug and extends therefrom through said outer side of said spine to provide the means for hanging said binder and directory adjacent a telephone.

The opposite end of the lanyard is attached to a mounting assembly for hanging the binder and its directory or directories near a telephone. The assembly comprises the lanyard having a head on said opposite end. A wall mounting member has a face plate with a keyhole slot therein. The head is small enough to pass through the larger part of said keyhole slot but large enough not to pass through the remainder of said keyhole slot. After the head is inserted in the slot, a mounting fastener to mount said wall mounting member on a wall is positioned in said larger part of the key hole slot to prevent the head of said lanyard from being withdrawn from said keyhole slot through the larger part.

In another form, the mounting assembly for hanging a binder and its directory or directories near a telephone comprises the lanyard with said head on said opposite end thereof, a wall mounting member having a face plate with an opening large enough to allow said head to pass therethrough, and a retaining washer behind said face plate. The washer has a keyhole slot with a first segment large enough to allow said head to pass therethrough and a second segment sized to allow said lanyard but not said head to pass therethrough. The keyhole slot, when said retaining washer is mounted behind said face plate with said lanyard in said second segment, has said first, larger segment non-aligned with said opening in said face plate, whereby the second, smaller segment of said keyhole slot prevents said lanyard and its head from being withdrawn through the opening in said wall mounting member.

PRIOR ART

A common type of telephone directory binder is a molded plastic or vinyl sheeted binder, in which a springable, bendable metal bar or rod extends along the inside of the binder near the spine and is secured at its opposite ends in metal tabs mounted on the binder spine at opposite, top and bottom ends of the telephone book. With only slight bending of the bar, the open telephone book can be slid out from beneath the bar, or the bar can be easily disconnected from one or both tabs. The directory mounting in the subject binders has three security features: (1) the spine portion of the directory sits in the well formed by the depression, which allows little sideward, upward and downward movement of the directory relative to the spine of the binder; (2) the wings of the thin metal mounting member are well "buried" between and within the directory pages near the spine and cannot readily be bent, ripped, cut or cracked by vandals; and (3) the tongue is "buried" in the spine where it is substantially inaccessible to damage by small tools or objects used by would-be vandals and is held in place by a vandal-resistant pin, ring, etc.

The binder and its tongue and wing mounting member thus provide for the mounting of telephone directories in binders which use less, and more economical, hardware parts to mount the directories and which are considerably more vandal-proof than are their more expensive predecessors now in use.

PREFERRED EMBODIMENTS

Preferred embodiments of the invention are illustrated in the accompanying drawings, wherein.

Figures 3, 5, 6, 9, 10, 11, 12, 13, 14:
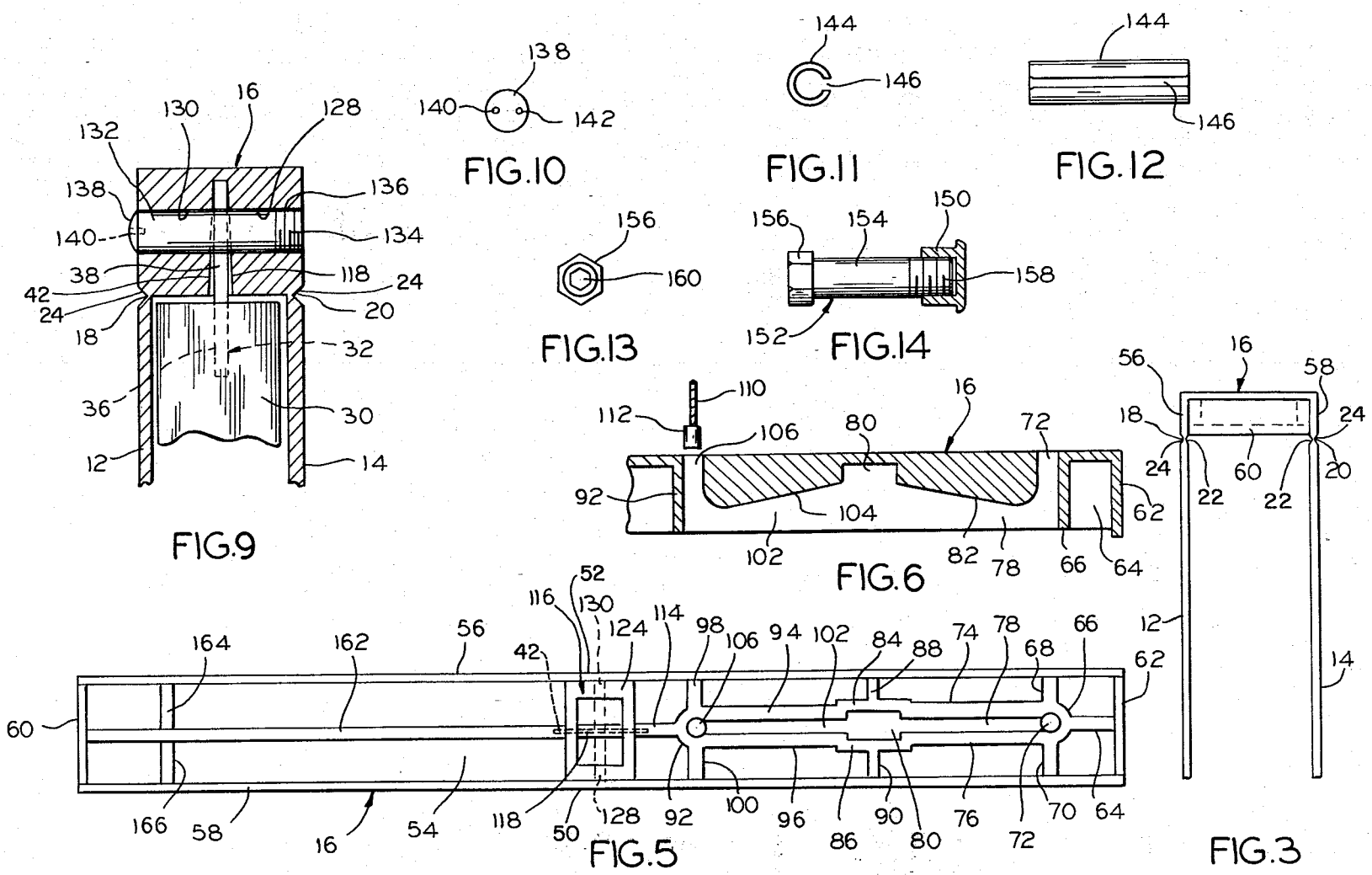
FIG. 3 is an end elevation of the binder.
FIG. 5 is a plan view of the inner side or face of the spine of said binder.
FIG. 6 is a longitudinal, fragmentary, center line cross section of said spine.
FIG. 9 is a fragmentary, transverse section of the binder and a directory mounted therein and shows a first embodiment of a pin used to hold the apertured tongue of the thin metal, directory-mounting member in the binder.
FIG. 10 is an end view of the pin of FIG. 9.
FIGS. 11 and 12 are, respectively, an end view and a side elevation of a second form of pin useable in place of the pin shown in FIGS. 9 and 10.
Figure 15:
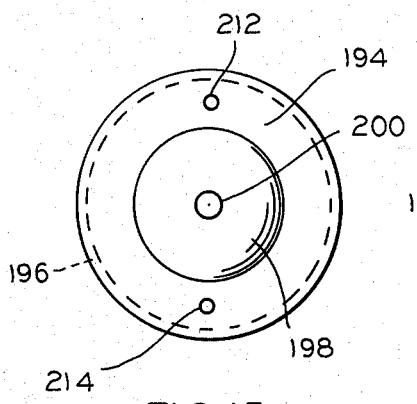
Figure 16:
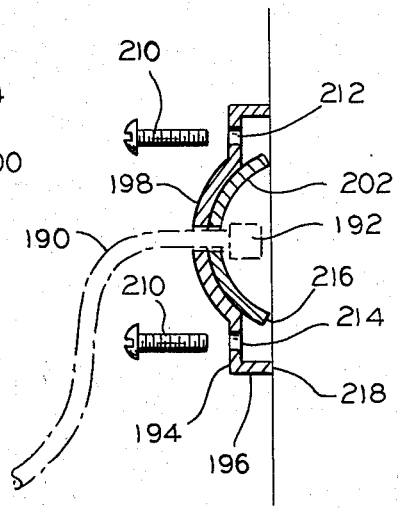
Figure 17:
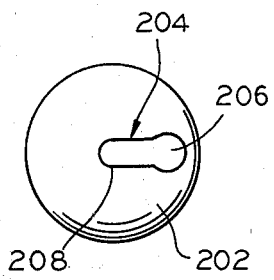
Figure 18:
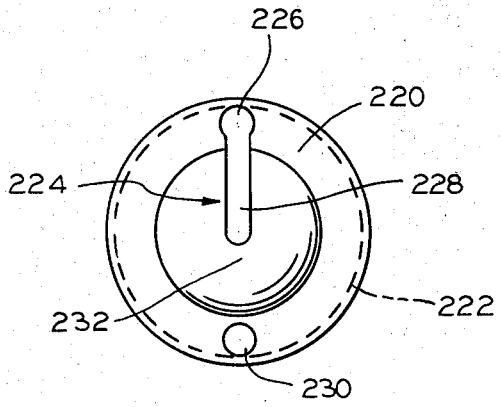
Figure 19:
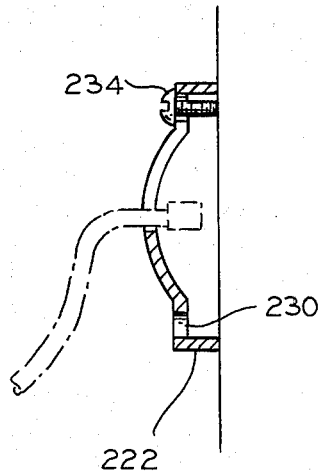

FIGS. 13 and 14, respectively, are an end view and a side elevation of a third form of pin plus a press-fit bushing used therewith;

FIGS. 15 and 16, respectively, are a front elevation and a diametric section of a lanyard wall-mounting member;

FIG. 17 is a front elevation of a retaining washer used in the wall-mounting member of FIGS. 15 and 16; and FIGS. 18 and 19, respectively, are a front elevation and a diametric section of an alternative form of a lanyard wall-mounting member.

Referring to the drawings, the binder 10 comprises an integral molding of a front cover panel 12, a rear cover panel 14 and a spine 16 hingedly joined along its longitudinal edges to the front and rear cover panels 12 and 14 by integrally molded, living hinges 18,20, which are weakened lines formed by the V-notch grooves 22,24. The inner face 26 of the spine has a shallow, rectangular well or depression 28 which receives the spine of the soft cover-bound telephone directory 30.

Figure 1:
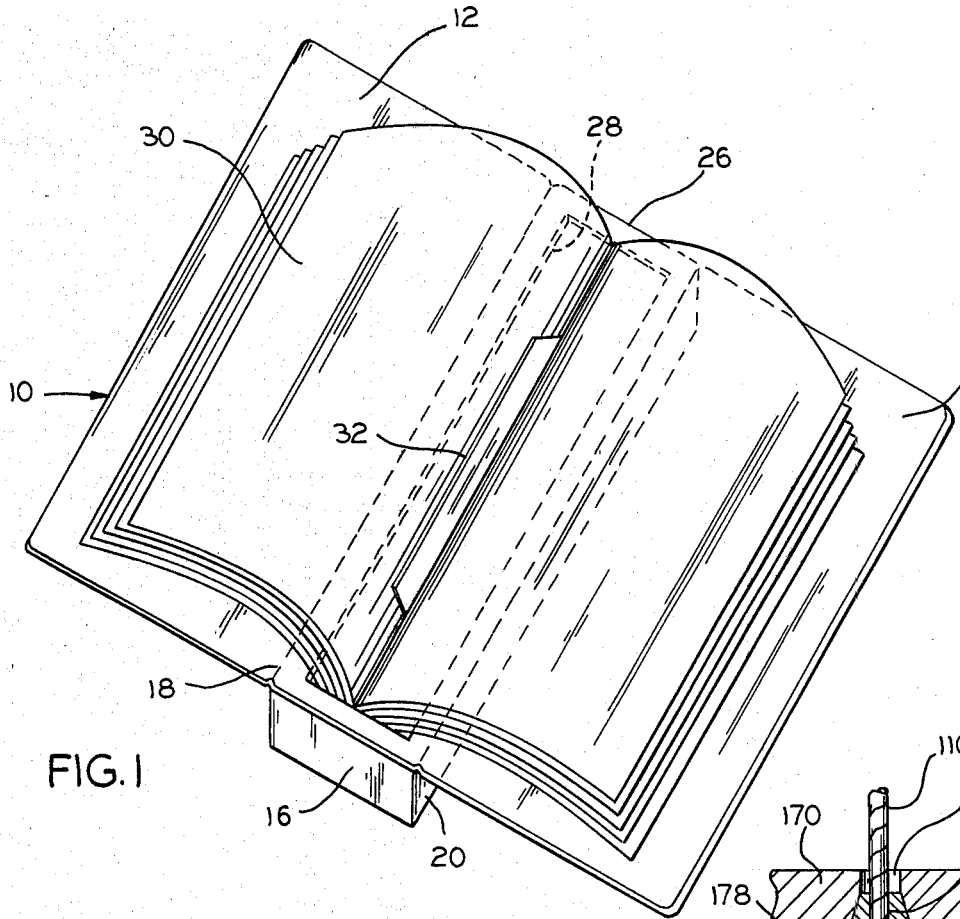
FIG. 1 is a perspective view of an open telephone directory mounted in a binder.

The directory 30 is mounted in the binder 10 by laying it open about in the middle (as shown in FIG. 1). A non-rust, stainless steel, flat, one piece metal security bar 32 comprising a pair of thin wings 34,36 extending laterally oppositely from the thin tongue 38 is placed in the V-groove formed by the open pages. The pointed, sharp-edged nose 40 of the tongue is pressed through the directory's spine and into a slot 42 in the spine until the hole 44 in the tongue aligns with the pair of aligned holes 128,130 in the walls 50,52 integrally molded on the inner side or face 54 of the spine.

Referring especially to FIGS 3–7, the well or depression 28 is formed by the spine's side walls 56,58 and its end walls 60,62. The outer edge segments of these walls secure the mounted directory or side-by-side directories in a given binder against being moved sidewise or lengthwise therein and further impede insertion of a tool such as a knife blade, screw driver, and the like between the back of the mounted directory and the inner side or face of the spine in an attempt to disengage the lanyard (e.g., FIGS. 5 and 6) from the spine.

The spine's inner wall or face 54 has integrally molded thereon, in addition to end walls, a number of other integrally molded walls. Referring to FIGS. 5 and 6, beginning at end wall 62, the inner wall or face has a center line wall or rib extending from end wall 62 to a semi-cylindrical wall 66. Strengthening walls or ribs 68,70 connect the diametrically opposite edges of the semi-cylindrical wall with the side walls 56,58. A round hole or passage 72 extends transversely through the spine, half of which hole is formed by the semi-cylindrical wall 66.

A pair of spaced, longitudinal walls 74,76 extend from the opposite, diametric edges of the wall 66 and form therebetween a center line, longitudinal groove 78. The groove intercepts the hole or passage 72 at one end and a rectilinear recess 80 at the other end. Preferably, the bottom 82 of the groove 78 slopes away from the inner face of the spine as it runs from the hole or passage 72 to the recess 80.

The recess 80 is formed by integrally molded side walls 84,86, which are spaced somewhat further apart than are the groove-forming walls 74,76. Reinforcement ribs 88,90 connect the centers of the side walls 84,86 with spine's side walls 56,58.

Preferably, though optionally, the integral wall structure on the inner face or side of the spine 16 may have, on the opposite end of the recess 80, additional walls 92,94,96 and ribs 98,100 which are the mirror image of semi-cylindrical wall 66, spaced, parallel, longitudinal walls 74,76, and ribs 68,70. These walls form a mirror image, center line, longitudinal groove 102 with a mirror image, sloping bottom 104—the groove 102 extending from the recess 80 to a round, transverse hole or passage 106 in the spine. Hole or passage 72 is located near the upper end of the spine, while hole or passage 106 is in the center portion of the spine.

The lanyard 110 for hanging the binder and its telephone directory near the public telephone has on its one end an enlargement, i.e., a cylindrical head 112, tightly mounted thereon. The width (diameter) of the head 112 is slightly less than the holes or passages 72,106, larger than the width of the grooves 78,102 and slightly less than the width of the recess 80. To mount the lanyard in the binder, the directory is removed. Depending on whether the binder and its directory are to hang with the spine substantially vertical or substantially horizontal, the head is passed through either hole or passage 72 or hole or passage 106 and then is laid in the recess 80. The head-contiguous end of the lanyard lies in either groove 78 or groove 102. The directory (or side-by-side directories) are then mounted in the binder—the backs(s) of the directory or directories lying against the coplanar outer edges of walls 74,76; 84,86; 94,96; and 66,92 and of the ribs 64; 68,70; 88,90; and 98,100. This closes the open side of the grooves 78,102 and recess 80 and keeps the head 106 in the recess and the lanyard in the groove. The interlock is substantially tamper-proof as long as the telephone directory or directories is/are in place in the binder. Access to the recess 80 to pry loose the head 112 with a thin tool, e.g., a knife blade or screw driver, by inserting it behind the back of the mounted directory is made difficult because the back lies within the well or depression 28 in the spine and the recess 80 and the head 112 therein lie deep within the spine's wall structure.

Figure 2:
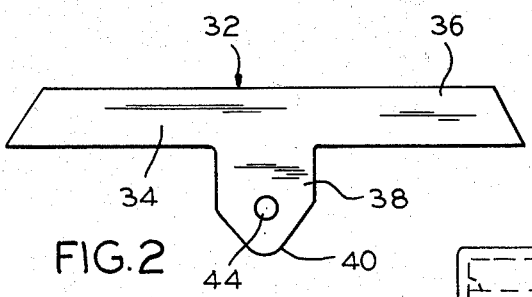
FIG. 2 is a side elevation of a thin metal member, partly visible in FIG. 1, used to secure the directory in the binder.
Figure 7:
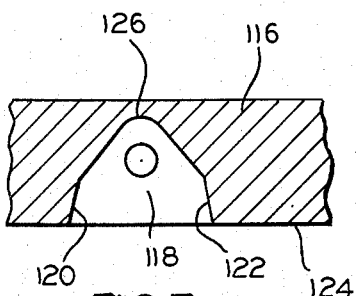
FIG. 7 is a detail view, in section, of the slot in the spine which receives the tongue of the thin metal, directory mounting member.

The inner side or face 54 of the spine has additional integrally molded structures including a center line wall 114 extending longitudinally from semi-cylindrical wall 92 to a block 116 in the center portion of the spine. The block has a single, narrow, longitudinal slot 118 having the configuration shown in FIG. 7. The end walls 120,122 taper from the face 124 to a rounded nose 126—the shape and size corresponding substantially to those of the tapered part of the tongue 38 of the thin metal member 32 (FIG. 2).

A pair of aligned, holes or passages 128, 130 extend transversely through the block 116 on opposite sides of the slot 118. The aperture 44 in the tongue 38 is substantially aligned therewith when the tongue is inserted full depth in slot 118. A pin 132 (FIG. 9) is inserted in the holes or passages 128,130 and through the aperture 44 in the tongue 38. This locks the thin metal member 32 in the binder—the metal member functioning as a security bar to keep the directory secured in the binder.

The pin 132 is a metal or plastic cylinder having a threaded end 134 which will self-tap in the diameter-reduced end 136 of the passage or hole 128. To make it more difficult to remove the pin, the end 138 has two or more small holes 140,142 (FIG. 10)—thereby requiring a special tool to impart rotation to the pin 132 in order to remove it.

FIGS. 11 and 12 show another type of pin which is difficult to unseat without a special tool. It is a spring pin or ferrule 144 made from a piece of spring steel rolled into a tube or ferrule of C-shaped transverse cross-section with a longitudinal slot allowing the tube to be springably forced into a smaller diameter. One (or both) of the holes or passages 128,130 has a diameter slightly smaller than the nominal diameter of the spring pin. By forcing the pin into the holes or passages 128,130, it becomes tightly wedged in one or both of them and requires a specially sized tool to drive it out again.

Another pin is shown in FIGS. 13 and 14. Here an internally threaded bushing 150 is press-fitted in an end of one hole or passage 128,130. The pin 152 has a shank 154 and a bead 156 both of smaller diameter than the holes or passages 128,130. The threaded end 158 of the shank is turned into the bushing, the last few turns being done by an Allen head wrench is the Allen head socket in the hex head 156 of the pin. When the pin is fully inserted, the hex head 156 is completely within the passage or hole 128 or 130 so that turning of the pin to loosen it can be initiated only via the Allen head socket 160.

If two or more directories are to be mounted side-by-side in the binder, a thin metal, security bar 32 is mounted in each directory. The slot 118 is widened so that it will receive the tongues 38 of all bars 32 (or individual slots 118 are provided for the tongue of each bar). The mounting pin 132,144 or 152 is passed through the aperture 44 of each bar 32.

The integrally molded wall and rib structure between block 116 and end 60 has a spine-rigidifying function. A longitudinal, center line rib 162 with one or more pairs of lateral ribs 164,166 serves this function.

Figure 8:
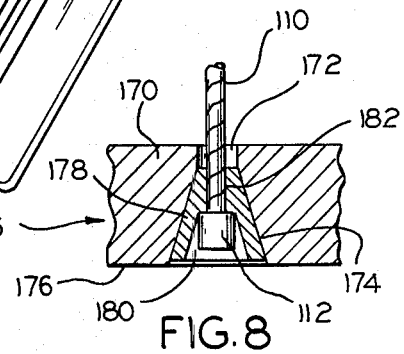
FIG. 8 is a detail view, in section, of a tapered passage through the spine and the head on a lanyard secured in a matingly tapered plug mounted in the passage, an alternate mode for securing one end of the lanyard to the binder.
Figure 4:
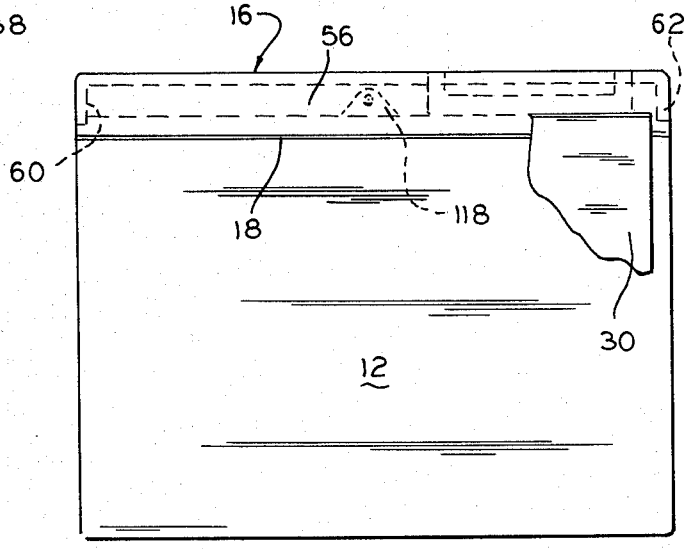
FIG. 4 is a side elevation thereof.

FIG. 8 shows an alternative mode for mounting the lanyard 110 on the spine. Instead of holes or passages 72,106, grooves 78,102 and recess 80, the inner side or face of the spine is provided with one or two integrally molded blocks 170, in each of which is provided a passage 172 positioned in the spine at substantially the same place(s) as is/are one or both of the passages or holes 72,106. At least a portion 174 of the passage(s) 172 is frusto-conically tapered in the direction away from the inner face 176 of the block 170. A hollow, frusto-conical plug 178 is removably seated in the portion 174. The plug has a stepped, axial passage. The head 112 of the lanyard 110 is seated in the larger diameter end 180 of the stepped axial passage, while the lanyard 110 extends through the smaller diameter, opposite end 182 of the stepped passage and out of the small end of the passage 172 in the outer face or side of the spine.

The plug-bearing end of the lanyard 110 is mounted in the passage 172,174 by removing the directory, and passing the opposite end of the lanyard through the passage until the tapered plug seats in the tapered part of the passage. The back of the directory, when mounted in the binder, keep the plug in the passage. Where the opposite end of the lanyard also has an enlargement like the head 112, the smallest end of the passage 172 should be large enough to let the head pass therethrough.

One passage 172 is sufficient. Two may be provided in order to allow the choice of hanging the directory and binder with the spine either substantially vertical or substantially horizontal.

Also, a hollow or tubular pin like that shown in FIGS. 11 and 12 offers another way to suspend bound telephone directories singly or side-by-side. Some public telephone sites have a plurality of side-by-side binders with a different directory in each, the binders being pivotally hung with the spines facing up on a rod which passes laterally through the spine of each binder. The hollow pin 144, which is located at or near the center (lengthwise) of the spine, will serve as the pivot bearing or sleeve for pivotal support of each binder and its directory. To use the directory, the binder is rotated on the rod 180°. When the binder and directory are laid open, the binder's cover panels 12,14 rest on the spines of adjacent directories.

The opposite end of the lanyard 110 may be mounted on a wall or other surface by the mounting members illustrated in FIGS. 15–19. In the embodiment of FIGS. 15–17, the opposite end 190 has an enlargement, i.e., a head 192, secured thereon. The mounting member is a round, face plate 194 with a rear, peripheral, cylindrical flange 196. The center portion of the plate 194 is a dome 198 with a radially central apexial hole 200. The hole has a diameter larger than that of the cylindrical head 192.

Behind the plate 194 is a domed retaining washer 202. It has a radial keyhole slot 204 with its circular, larger segment 206 at the radially outer end of the radial slot forming the narrower segment 208. The face plate is mounted on a wall or other surface by screws 210 positioned in screw holes 212,214.

Before the plate 194 is mounted by the screws, the head 192 is inserted through hole 200 in the plate and circular segment 206 of the keyhole slot. The segment 206 has a diameter greater than that of the cylindrical head while the width of the slot 208 is slightly more than the diameter of the lanyard 110, but smaller than the diameter of the head. When the lanyard is pulled to draw the domed retaining washer to the concentric position shown in FIG. 15, the head 192 is behind the radial slot 208. The larger, circular segment 206 remains offset relative to hole 200, whereby the head 192, in the assembled mounting member, will not slip through the circular segment. To hold this position, even when the lanyard is slack, the peripheral edge 216 of the washer preferably lies, in the assembled, mounted combination, in about the same plane as the rear, peripheral edge 218 of the flange 196 so that the edge 216 of the washer abuts or substantially abuts the wall or other surface to which the lanyard-mounted member is attached.

In the embodiment of FIGS. 18 and 19, the round, face plate 220 of the mounting member has a rear, peripheral flange 222. A radial, keyhole slot 224 has a radial slot segment 228 with a circular, larger segment 226 at its radially outer end. The size relationships of the segments 226 and 228, and the diameters of lanyard 110 and cylindrical head 192 are the same as described above for the keyhole slot in the retaining washer 202. The face plate may have a domed, central portion 232.

The lanyard is mounted in the member 220 by pushing the lanyard's head 192 through the circular segment 226, sliding the lanyard radially inwardly in the slot segment 228, and mounting the member on a wall or other surface by screws 234 placed in keyhole's circular segment 226 and screw hole 230. The screw in keyhole segment 226 blocks exit of the head 192 therethrough.

It will be appreciated from the foregoing that the invention herein can take many forms other than the preferred forms shown in the drawings, and that the invention as herein claimed is not limited to the illustrated embodiments.

I claim:

1. A binder for books, which comprises a front cover panel, a rear cover panel, and a spine along whose opposite longitudinal edges the front and rear cover panels respectively are hingedly connected, and means for protectively securing on said spine and between said cover panels a book, said means being a thin metal member with oppositely extending wings adapted to lie between and against the bound edges of the pages of the directory and a thin edged tongue adapted to penetrate the bound edges of said pages and project through a slot in the spine, and means coacting with said spine-projecting part, and said spine for locking said tongue and said wings in book-securing position to prevent removal of said book from said binder, and the spine of said binder having a rectangular well formed by opposite side walls and opposite end walls for securely holding the back of said book or the backs of two or more books.

2. A binder for books, which comprises a front cover panel, a rear cover panel, and a spine along whose opposite longitudinal edges the front and rear cover panels respectively are hingedly connected, and means for protectively securing on said spine and between said cover panels a book, said means being a thin metal member with oppositely extending wings adapted to lie between and against the bound edges of the pages of the book and a thin edged tongue adapted to penetrate the bound edges of said pages and project through a slot in the spine, a hole in said tongue, a transverse passage in said spine, and a removable fastener member extending through said passage and said hole, thereby locking said tongue in said slot of said spine to prevent removal of said book from said binder.

3. A binder for books, which comprises a front cover panel, a rear cover panel, and a spine along whose opposite longitudinal edges the front and rear cover panels respectively are hingedly connected, and means for protectively securing on said spine and between said cover panels a book, said means being a thin metal member with oppositely extending wings adapted to lie between and against the bound edges of the pages of the book and a thin edged tongue adapted to penetrate the bound edges of said pages and project through a slot in the spine, and means removably mounted in said spine and coacting with said tongue for locking said tongue and wings in book-securing position to prevent removal of said book from said binder, and a rectangular well in said spine formed by opposite side walls and opposite end walls for securely holding the back of said hook.

4. A binder as claimed in claim 1 or 2 or 3 wherein said front cover panel, said rear cover panel and said spine constitute an integral molding of a thermoplastic polymer with said spine and said cover panels being hingedly connected by living hinges.

5. A binder as claimed in claims 1 or 3, wherein said means coacting with said spine projecting part comprises a pair of holes in said spine on opposite sides of said tongue when it is inserted in said slot in said spine, said pair of holes and a hole in the slot-inserted tongue being substantially aligned, and a pin removably seated in and extending through the three holes to secure said thin metal member in its book-holding position.

6. A binder as claimed in claim 5, wherein said pin has a threaded end threadedly fitted in one of said pair of holes or in a bushing press-fitted therein.

7. A binder as claimed in claim 5, wherein said pin is a springable ferrule springably compressibly seated in said pair of holes.

8. A binder for telephone directories used in public telephone facilities and the like, which comprises a front cover panel, a rear cover panel, and a spine along whose opposite longitudinal edges the front and rear cover panels respectively are hingedly connected, and means for protectively securing on said spine and between said cover panels a telephone directory, the inner side of said spine having a longitudinal groove intercepting a recess in said inner side, a passage extending between said groove and the outer side of said spine, a lanyard extending through said passage and said groove to provide means for hanging said binder and directory adjacent a telephone, and a head on said lanyard seated in said recess and preventing said lanyard from being pulled out of said groove and passage.

9. A binder as claimed in claim 8, wherein the back of said telephone directory lays across said groove and recess to preclude access to the portion of said lanyard in said groove and recess.

10. A binder for telephone directories used in public telephone facilities and the like, which comprises a front cover panel, a rear cover panel, and a spine along whose opposite longitudinal edges the front and rear cover panels respectively are hingedly connected, and means for protectively securing on said spine and between said cover panels a telephone directory, said spine having a transverse passage extending from the inner side to the outer side of said spine, at least a portion of said passage being tapered, a tapered plug matingly seated in said tapered portion, one end of a lanyard being fixedly mounted in said plug and extending therefrom through said outer side of said spine to provide means for hanging said binder and directory adjacent a telephone.

11. A binder as claimed in claim 3 wherein said means embodies a hole in said tongue, a transverse passage in said spine, and a removable fastener member extending through said passage and said hole, thereby locking said tongue in said slot of said spine.

12. A binder as claimed in claim 2 wherein said spine has a rectangular well formed by opposite side walls and opposite end walls for securely holding the back of said book.

13. A binder for books and the like which comprises a front cover panel, a rear cover panel, and a spine along whose opposite longitudinal edges the front and rear cover panels respectively are hingedly connected, and means for protectively securing on said spine and between said cover panels a book, the inner side of said spine having a longitudinal groove intercepting a recess in said inner side, a passage extending between said groove and the outer side of said spine, a lanyard extending through said passage and said groove to provide means for attaching said binder and book to a wall, a table, or the like, and a head on said lanyard seated in said recess and preventing said lanyard from being pulled out of said groove and passage.

14. A binder as claimed in claim 13, wherein the back of said book lays across said groove and recess to preclude access to the portion of said lanyard in said groove and recess.

15. A binder for books and the like, which comprises a front cover panel, a rear cover panel, and a spine along whose opposite longitudinal edges the front and rear cover panels respectively are hingedly connected, and means for protectively securing on said spine and between said covers a book, said spine having a transverse passage extending from the inner side to the outer side of said spine, at least a portion of said passage being tapered, a tapered plug matingly seated in said tapered portion, one end of a lanyard being fixedly mounted in said plug and extending therefrom through said outer side of said spine to provide means for attaching said binder and book to a wall, a table, or the like.

16. A binder as claimed in claim 8, or 10, or 13, or 15 wherein said lanyard is attached to a wall, a table, or the like by an attachment comprising:

a head on one end of said lanyard, a mounting member having a face plate with a keyhole slot therein, said head being small enough to pass through the larger part of said keyhole slot but large enough not to pass through the remainder of said keyhole slot, and a mounting fastener to mount said mounting member and positioned in said larger part to prevent the head of said lanyard from being withdrawn from said keyhole slot.

17. A binder as claimed in claim 8, or 10, or 13, or 15 wherein said lanyard is attached to a wall, a table, or the like by an attachment comprising:

a head on one end of said lanyard, a mounting member having a face plate with an opening large enough to allow said head to pass therethrough, a retaining washer behind said face plate, a keyhole slot in said washer, said keyhole slot having a first segment large enough to allow said head to pass therethrough and a second segment sized to allow said lanyard but not said head to pass therethrough, and said keyhole slot, when said retaining washer is mounted behind said face plate with said lanyard in said second segment, having said first segment non-aligned with said opening in said first plate, whereby the second segment of said keyhole slot prevents said lanyard and its head from being withdrawn through the opening in said mounting member.

18. A binder as claimed in claims 6 or 2 or 3 wherein said book is a telephone directory.

* * * * *

UNITED STATES PATENT AND TRADEMARK OFFICE

CERTIFICATE OF CORRECTION

PATENT NO. : 4,352,583

DATED : October 5, 1982

INVENTOR(S) : Dominic R. Errichiello

It is certified that error appears in the above–identified patent and that said Letters Patent are hereby corrected as shown below:

Column 6, line 56, "is" should read --in--;

Column 11, line 1, "first" should read --face--;

Column 12, line 3, "6" should read --1--.

Signed and Sealed this

Tenth Day of May 1983

[SEAL]

*Attest:*

GERALD J. MOSSINGHOFF

*Attesting Officer*

*Commissioner of Patents and Trademarks*